US007104926B2

(12) United States Patent
Carlson

(10) Patent No.: US 7,104,926 B2
(45) Date of Patent: Sep. 12, 2006

(54) EXERCISING MACHINE FOR WORKING MUSCLES THAT SUPPORT THE SPINE

(75) Inventor: Alan Carlson, Lago Vista, TX (US)

(73) Assignee: Dynabolic Gym Equipment, Lago Vista, TX (US)

( * ) Notice: Subject to any disclaimer, the term of this patent is extended or adjusted under 35 U.S.C. 154(b) by 408 days.

(21) Appl. No.: 10/219,976

(22) Filed: Aug. 15, 2002

(65) Prior Publication Data

US 2004/0033863 A1 Feb. 19, 2004

(51) Int. Cl.
*A63B 23/025* (2006.01)
*A63B 21/02* (2006.01)

(52) U.S. Cl. ..... 482/10; 482/129; 482/130; 482/139; 601/39

(58) Field of Classification Search ..... 482/10, 482/11, 92, 101, 121, 129, 130, 135, 139, 482/148, 105, 124; 601/39, 25; 602/17; 600/594; 73/379.01
See application file for complete search history.

(56) References Cited

U.S. PATENT DOCUMENTS 3,205,303 A * 9/1965 Bradley ..... 348/211.4
3,290,985 A * 12/1966 Bains et al. ..... 359/896
4,149,713 A 4/1979 Mcleod
4,219,193 A 8/1980 Newman
4,278,249 A * 7/1981 Forrest ..... 482/10
4,537,393 A 8/1985 Kusch
4,583,731 A 4/1986 Crivello
4,586,515 A * 5/1986 Berger ..... 600/595
4,640,268 A 2/1987 Roberts
4,645,198 A 2/1987 Levenston
4,768,779 A * 9/1988 Oehman et al. ..... 482/10
4,845,987 A * 7/1989 Kenneth ..... 73/379.01
4,872,668 A 10/1989 McGillis et al.
4,893,808 A * 1/1990 McIntyre et al. ..... 482/5
4,954,815 A * 9/1990 Delmonte ..... 600/595
5,116,359 A * 5/1992 Moore ..... 606/241
5,252,070 A * 10/1993 Jarrett ..... 434/59
5,324,247 A * 6/1994 Lepley ..... 482/134
5,336,138 A * 8/1994 Arjawat ..... 482/10
5,577,981 A * 11/1996 Jarvik ..... 482/4
5,643,162 A 7/1997 Landers et al.
5,713,370 A 2/1998 Cook
5,984,836 A 11/1999 Casali
5,997,440 A * 12/1999 Hanoun ..... 482/10
6,106,437 A 8/2000 Brooks (Continued)

FOREIGN PATENT DOCUMENTS

FR 2661333 A1 * 10/1991
FR 2702665 A1 * 9/1994

*Primary Examiner*—Jerome Donnelly
*Assistant Examiner*—Victor K. Hwang
(74) *Attorney, Agent, or Firm*—Alan Carlson

(57) ABSTRACT

An exercising machine is provided that has a head engaging member that can provide a hemispherical movement. The head engaging member is attached to rollers that can roll on a pivotable arcuate track. As an exerciser moves the head engaging member in the X-Y plane, the machine forces movement in the Z plane such that the head engaging member can maintain a point of contact on the user's head as the exerciser rotates his head during exercise. The track can be arced or formed in a radius such that the head engaging member traverses a motion approximate to a radius of a neck rotation as measured from the forehead to the base of the neck.

26 Claims, 8 Drawing Sheets

U.S. PATENT DOCUMENTS 6,551,214 B1 * 4/2003 Taimela ..... 482/10
6,599,257 B1 * 7/2003 Al-Obaidi et al. ..... 601/5
2002/0016561 A1 * 2/2002 Prinsloo ..... 602/17
2003/0148863 A1 * 8/2003 Thomas ..... 482/122
2004/0033869 A1 * 2/2004 Carlson ..... 482/121
2004/0220500 A1 * 11/2004 Dahl ..... 601/5

* cited by examiner

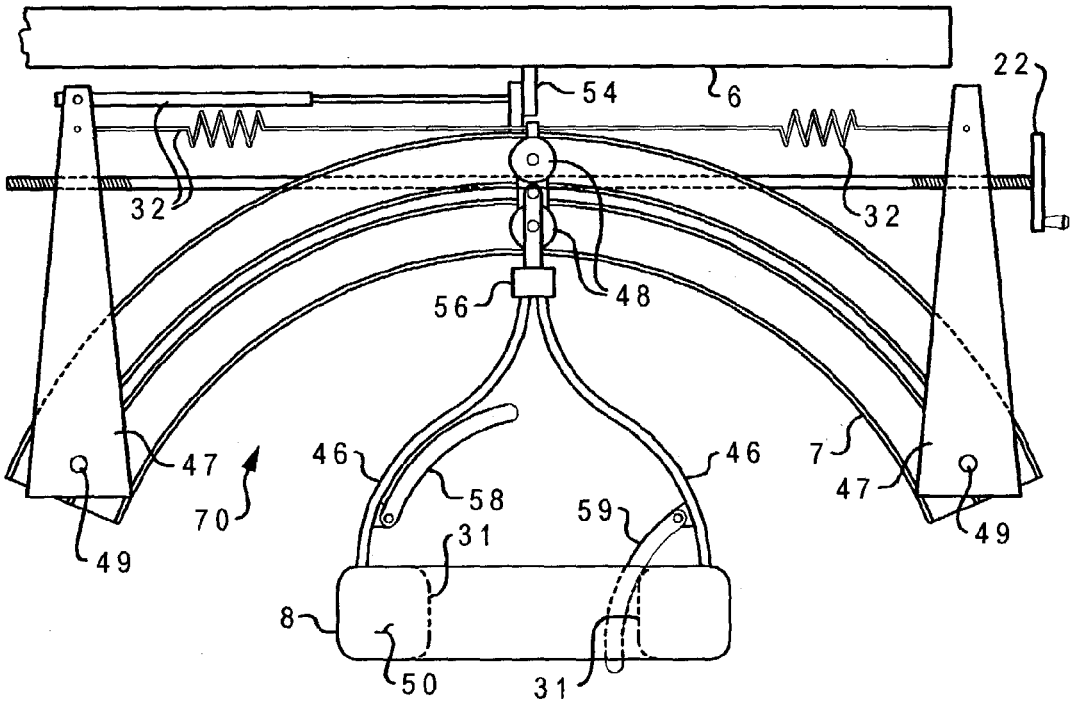
Fig. 2
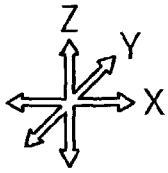

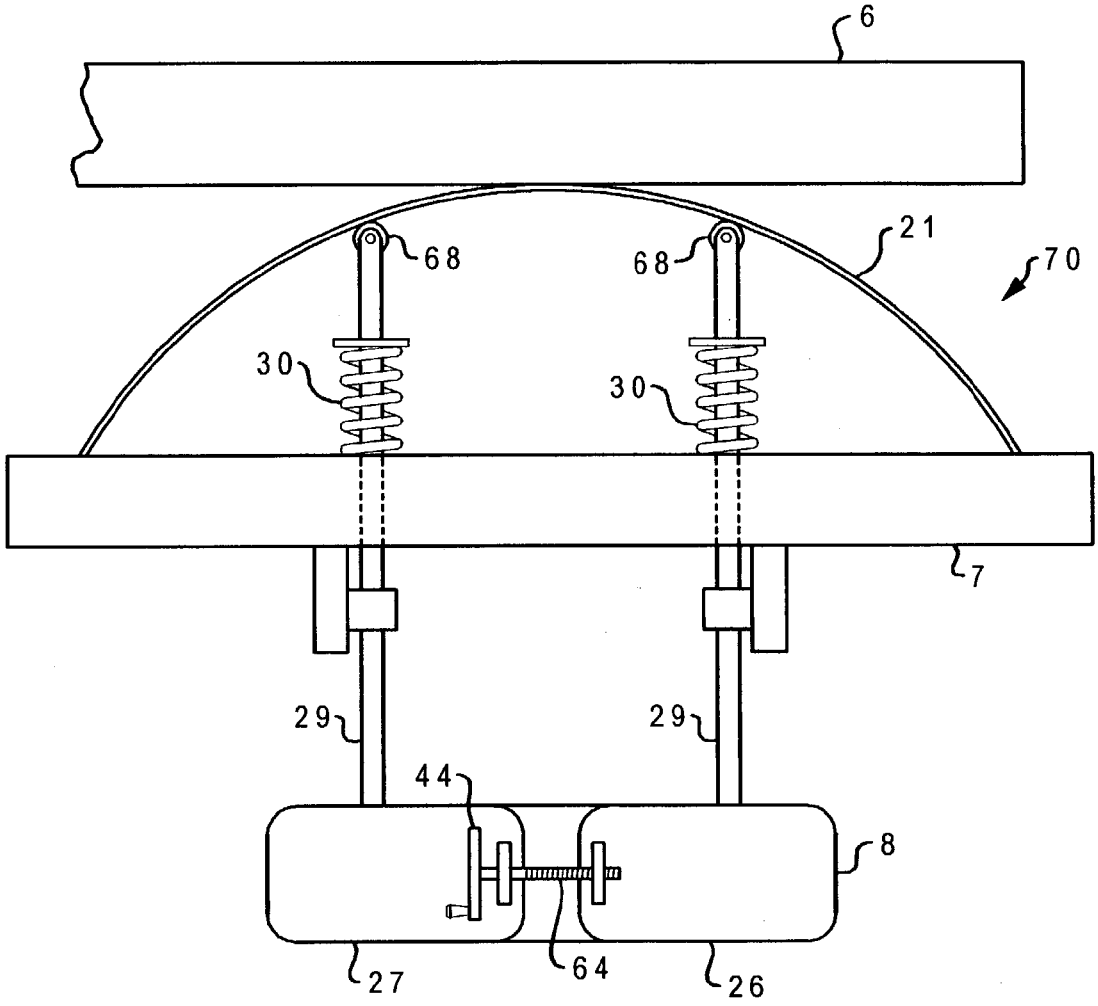
Fig. 5
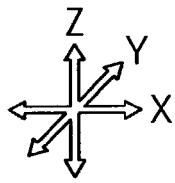

EXERCISING MACHINE FOR WORKING MUSCLES THAT SUPPORT THE SPINE

FIELD OF THE INVENTION

This invention relates to exercise equipment for the human body and in particular exercise equipment for all muscle groups which support the spine.

BACKGROUND OF THE INVENTION

Each year spinal cord injuries occur in contact sports such as football and wrestling. Many of these injuries could be prevented if the athlete had stronger muscles along the spinal cord. Prevention of spinal cord injuries is extremely important because these injuries often result in paralysis. One of the areas of the spinal cord which is susceptible to injury is the cervical area of the spine which resides between the shoulders and the skull. During collisions in football or during a fall or collision in any sport, the head can be snapped or over extended in relation to the body resulting in spinal cord injury and possible paralysis from the neck down.

Many have created exercising machines and methods for the neck and portions of the spine. For example U.S. Pat. No. 4,537,393 by Kusch and U.S. Pat. No. 5,984,836 by Casali provided an outer ring member with radial members pulling on all sides of a headgear. Other concepts such as U.S. Pat. No. 6,106,437 by Brooks uses the ring and two radial members connected to a pulley and a weight. Prior art devices fail to be widely accepted by athletes, trainers and weight programs for numerous reasons. One reason is the difficulty for individuals to get into and out of the exercise machine. Set up time for height and tension and head size adjustment all detract from the usability of the machine. Often, athletic teams working out together wherein, each athlete moves from exercise machine to exercise machine at timed intervals (referred to as circuit training). In this setting athletes only have a short time to exercise at a machine. If a particular machine requires too much set up time it cannot be used efficiently in circuit training. If a user is required to make numerous and/or precise adjustments to an exercise machine the setup becomes too much hassle and athletes will not use the machine. In order for a machine to be useful, the machine must be easily adjustable for users of all sizes. For example, a small youth and a three hundred and seventy five pound pro football player should be able to use the same machine. Other problems in the prior art include inadequate hygiene. Most prior art have a headgear which is made from leather or rigid plastic and these materials can cause cuts or abrasions to the skin where the head gear contacts the users head. The head gear in the prior art head often slides on the users skin making a work out uncomfortable. Additionally, the contact surfaces of the head gear is often not cleanable or sanitary. Another problem with prior art devices is that the resistance provided by the machine during exercise is undamped and does not provide a fluent and responsive motion. Additionally, in prior art devices the head gear slides on the exerciser's head during exercise causing discomfort and an awkward feeling. The prior art falls short and is less than perfect in many respects.

SUMMARY

An exercising machine is disclosed which can move in any direction in the X-Y plane on a multi-directional track. The head engaging member is coupled the multi-directional track and the multidirectional track is coupled to an arm that is moveable up and down on a frame to accommodate users of different heights. In one embodiment the multidirectional track is a swivel-able on the arm and as a user pushes the head engaging apparatus in a direction, the track will align with the direction of the user's push and then the rollers will start rolling on the track. In another embodiment the multi-directional track includes a first track mounted to a second track and the second track is mounted to the head engaging harness, wherein the first track can move in a first direction and the second track can moves in a second direction allowing the head engaging member to move in an infinite amount of directions in the X-Y plane. In another embodiment, as an exerciser moves the head engaging member in the X-Y plane the machine forces movement in the Z plane such that the head engaging member can maintain a point of contact on the users head as the exerciser rotates his head during exercise. At least one biasing member is coupled between the frame and the head engaging member to place a biasing force on the head engaging member. As a net force is applied to the head engaging member by the user, the biasing member(s) resist movement from the rest position thereby providing resistance to the user as the user exercises the muscles of the spine. The track can be arced or formed in a radius such that the head engaging member traverses a motion approximate to a radius of a neck rotation as measured from the forehead to the base of the neck. In other embodiments push rods roll on a dish surface to provide the arc movement of the head engaging member. In other embodiments, the arc of travel of the head engaging member can be adjusted by the user to accommodate the dimensions of the user.

BRIEF DESCRIPTION OF THE DRAWINGS

FIG. 2 is a depiction of a head engaging member and a single track multi-directional track system for an exercising machine;

FIG. 5 is a side view of another multi-directional track system utilizing a dish shaped mechanism with push rods for controlling an arced path which moves the head engaging member in the Z axis as it moves from a rest position;

DETAILED DESCRIPTION

Figure 1:
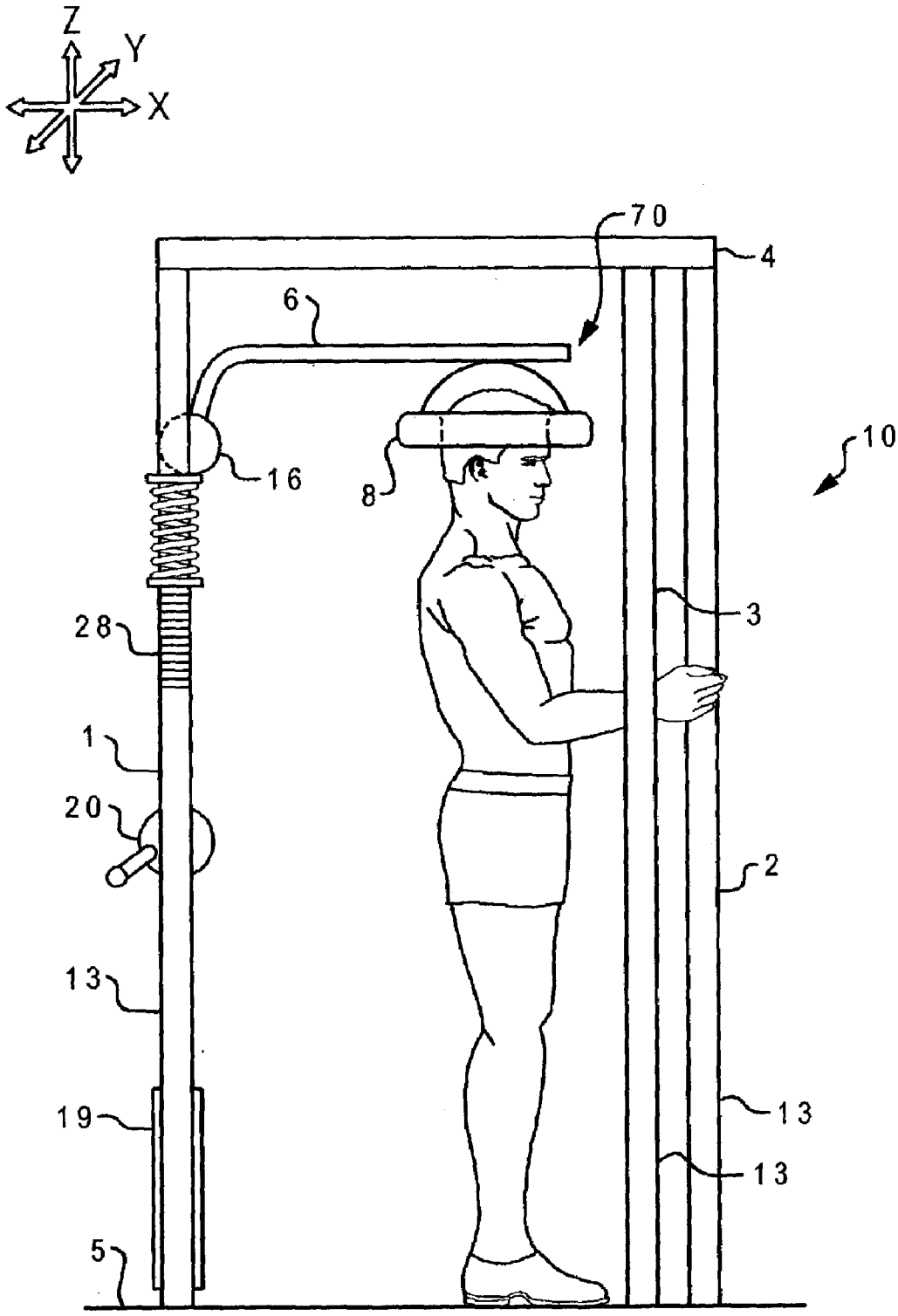
FIG. 1 is a side elevational illustration of an exercising machine.

Referring to FIG. 1, an exercise machine 10 is depicted which can be utilized to exercise all of the muscles supporting the spinal column. The exercise machine 10 may be comprised of a base 5 tying together frame members 13 Frame members 13 are comprised of a first frame member 1, a second frame member 2 and a third frame member 3.

The frame members 13 can also be joined at the top by fourth frame member 4. Of course, the shape, size, number, and configuration of frame members 13 can be altered by others and this will not part from the scope of the present invention. Generally, between an arm assembly 6 and the head engaging member 8, the exercise machine 10 can have a multidirectional track system 70 (not detailed in FIG. 1 but detailed in different embodiments in FIGS. 2–8).

In a preferred embodiment first frame member 1, second frame 2 member and third frame member 3 are configured to slidably support an arm assembly 6, and second and third frame members 2 and 3 also provide hand grips for the user to pull on and push on during a work out. Alternately, only the first frame member 1 could be used to support the arm assemble 6. The arm assembly 6 can move up and down in relation to frame members 13 to accommodate the height of the user of the exercise machine 10. If the user is to exercise in the seated position (not shown) the distance of movement of the arm assembly 6 can be minimized. In a preferred embodiment the arm assembly 6 is biased upward on a damped spring or a gas charges strut, shock or actuator and the user can pull the arm assembly 6 (and head harness 8) down to the desired height and release an interlock 16 or inserts a pin between the arm assembly 6 and a first frame member 1 to secure the arm assembly 6 to the frame 13 prior to an exercise secession. It is preferred to put markings 28 on one at least one frame member such that a user can move the head engaging member 8 to the appropriate height prior to an exercise session.

In an alternate embodiment a first actuator 20 can be utilized to raise and lower the arm assembly 6 in relation to the frame members 13. First actuator 20 could be a hand crank to drive a lead screw, or wind a cable to raise and lower the head engaging member 8. Alternately, first actuator 20 could be an electrical switch to drive an electromechanical system 19 for moving the arm assembly 6 up and down on the frame members 13. Many electromechanical systems could be utilized to raise and lower the arm assembly 6 and the head engaging member 8 such as a linear actuator. After inserting his or her head into the head engaging member 8 the user can move his/her head and push on the padding of the head engaging member and move the head engaging member 8 in any direction in the X or Y plane (360 degrees). Multi-directional track system 70 allows head engaging member 8 to make a controlled path movement in the X-Y plane.

Referring to FIG. 2 a more detailed view of a multi-directional track 70 is depicted. In FIGS. 1 and 2 like components have like call outs. The arm assembly 6 is coupled to track 7, and track 7 is coupled to the head engaging member 8. First swivel 54 is fixed at its first end to the arm assembly 6 and at its second end to the track 7. Rollers 48 follow track 7. The rollers 48 are coupled to second swivel 56 and second swivel 56 is coupled to coupling members 46. Coupling members 46 attach second swivel 56 to head engaging member 8. At least one biasing member 32 is assembled between the arm assembly 6 and the head engaging member 8 such that the head engaging member 8 is biased at a rest position near a central location of the exercise machine 10. First swivel 54 can be placed at a position on the track 7 that is offset from the position of the rollers 48 in the rest position. When a user places a force on the head engaging member 8 in the X-Y plane, the track 7 will swivel about the first swivel 54 and the track 7 will turn such that it aligns with the direction of the force which the user is placing on the head engaging member 8. After the track 7 aligns with the direction of the push the rollers will begin to roll in the track 7.

In a preferred embodiment the head engaging member 8 does not twist on the users head as the user pushes on the head engaging member 8 and maintains a its X-Y orientation as it translates through the X-Y plane. Alternately described, all frame 13 and arm assembly 6 members which are parallel to components of the head engaging member 8 when the head engaging member 8 is in the rest position remain substantially parallel throughout the motion allowed by the exercise machine.

When a user places a force on the head engaging member 8 in the Y direction the track 7 spins or rotates to align with the direction of the user supplied force and thereafter, the movement of the head engaging apparatus 8 moves the rollers 48 along the track 7. The user works against the force of the stretching or compressing biasing member 32. The multi-directional, fixed path movement of the head engaging member 8 on the multi-directional track 70 creates smooth, controlled path damped motion for exercising muscles of the spine.

The head engaging member 8 can take many shapes or forms. It may be a circular, elliptical, U shaped, arcuate, or an open or closed polygonal member. It is preferred that the frame of the head engaging member 8 is rigid. The head engaging member 8 has an opening suitable for insertion of the human head. The size of the opening may be adjustable to accommodate users with different head sizes. In one embodiment first flip down members 58 (shown in the up position) and second flip down member 59 (shown in the down position) can be moved into or out of the opening to reduce or increase the size of the opening in the head engaging member 8.

It is preferred to place padding 50 on the inner circumference of the head engaging member 8 and cover the padding with a fabric that does not absorb water or easily collect dirt. The contact surface 31 of the opening can be a vinyl or Neoprene™ material or any fabric which is easy to wipe clean of sweat between users. Padding 50 can be a closed cell foam, an air bladder, or a gel material or any compressive material which can cushion a users head. A user can adjust the resistance to movement of the head engaging apparatus by turning second actuator 22 which moves bias adjustment arms 47 on pivot points 49 and places more or less tension on the biasing member 32.

Figure 3:
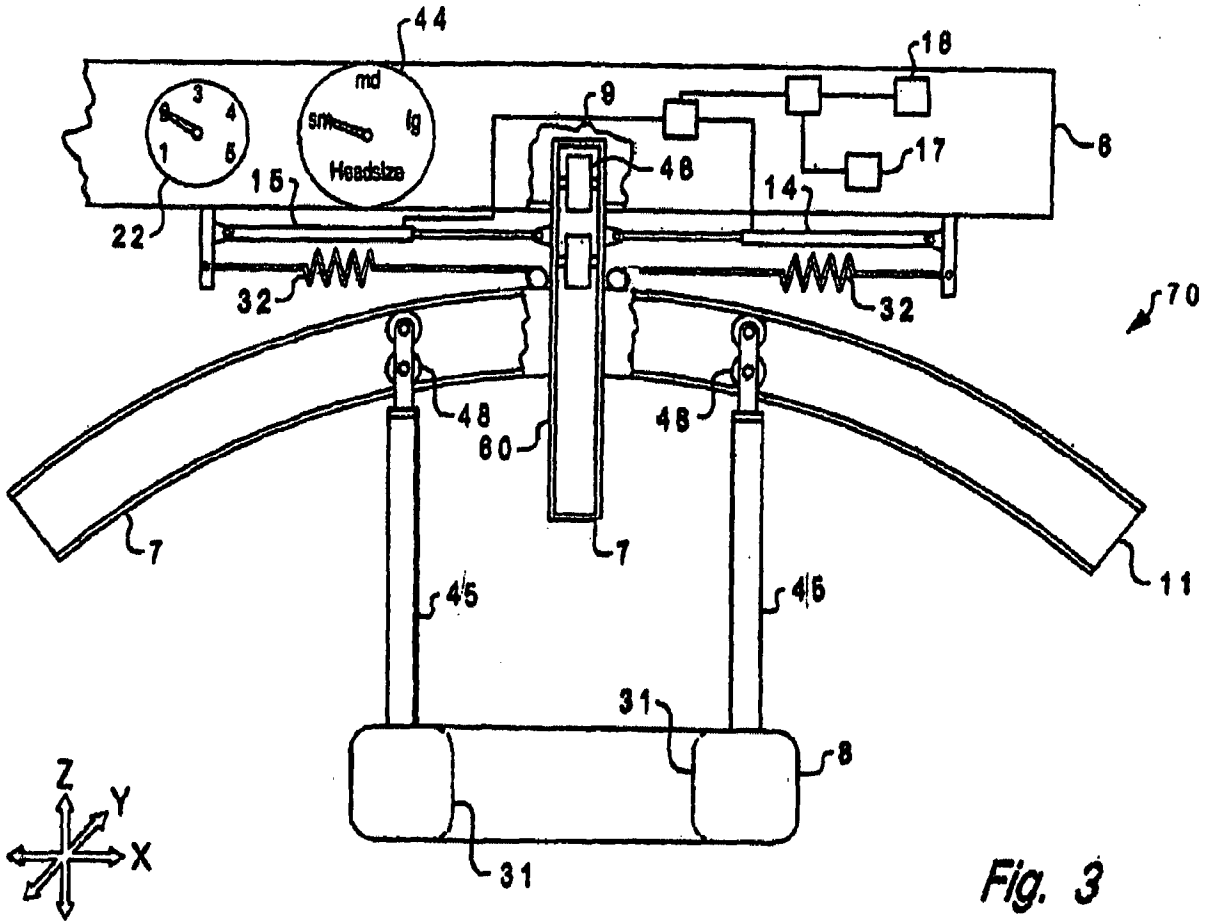
FIG. 3 is an side illustration of a head engaging member and a two track multi-directional track system wherein a portion of one of the tracks assembly is cut away for an exercising machine.

Referring to FIG. 3 another embodiment of a multi-directional track system 70 which has a first track 60 and a second track 11 coupling the arm 6 to the head engaging member 8 is illustrated. In FIGS. 1–3 like components have like call outs. The two track embodiment allows multi-directional movement of the head engaging apparatus 8. The first track 60 is coupled to the arm 6 and a second track 11 is coupled to rollers 48 (shown in the cut away view bounded by window 9) which ride in the first track 60. The tracks 60 and 11 can be positioned such that they are in series and move at a ninety degree angle (or substantially perpendicular) to each other. For example, if a user moves his head in the X direction the rollers 48 in second track 11 move along the second track 11 (there is no substantial roller movement along the first track 60). Alternately, as the user moves his head in the Y direction, the head engaging harnesses 8 moves with the second track 11 along first track 60 (the second track 11 moves along the first track 60 and head engaging harness 8 would not move substantially in relation to the second track 11). The "perpendicular" connection of the tracks allows the head engaging member 8 to move in all directions in the X-Y plane. When a user moves his head in another directions such as at a 45° angle to the X direction and a 45° angle to the Y direction all rollers 48 will move within the tracks.

First track 60 and second track 11 are arcuate and as the head engaging member 8 to moves in the X or Y direction from the rest position it moves in the Z direction. The movement of the head engaging apparatus 8 in the Z plane allows a point on the contact surface 31 and a point on the users head to remain in continual contact through the entire range of motion in exercising the neck such that abrasions to the users skin can be avoided. Additionally, there is no requirement that the head engaging member fits tightly on an exercisers head.

At least one biasing member 32 is assembled between the arm assembly 6 and the head engaging member 8 such that the head engaging member 8 is biased at a rest position, near a central location of the exercise machine. This multi-directional track guided movement provides superior results for exercising and strengthening the muscles which support the head, neck and spine because every muscle supporting the spine can be exercised. The biasing member(s) 32 such as a wound spring, a latex band or other stretchable or compressive member resists movement of the head engaging member 8 in any direction away from the rest position (they provide a resistive force). Thus, the biasing member(s) 32 will return the head engaging member 8 to a position of rest after the exerciser is done. In the rest position, all of the net forces are equal and when a force is placed on the head engaging member 8 in any direction by a user, the biasing member(s) 32 are stretched or compressed resisting the movement of the user and working the corresponding muscles.

The biasing member 32 provides a resistive force and it can also damp the movement of the head engaging apparatus 8. In one embodiment an air cylinder 14 is used as a biasing member. First air cylinder 14 can be placed between the arm assembly 6 and the head engaging member 8 to provide a variable resistive and damping force to the exerciser's movement. A second actuator 22 can be used to set the amount of resistance encounter by a user who tries to move (or is moving) the head engaging member 8 in relation to the arm assembly 6. In a preferred embodiment a second air cylinder 15 is also utilized, wherein the first cylinder 14 can be used to resist motion to the front and back the (X direction) and the second air cylinder 15 can be utilized to resist motion from one side to the other (Y direction) of the exercise machine 10. The second actuator 22 can control airflow to and from the air cylinders to provide infinite number of resistive settings for the user. Further, resistance can be set based on the direction of the movement of the head engaging member 8 from the rest position.

When the piston actuator of a typical air cylinder moves in one direction it pulls air in a first port and exhausts air out of a second port. One way in which second actuator 22 may control resistance and damping is to control the air flow to and from the cylinders. For example, a check valve 17 placed in parallel with an adjustable flow valve 18, both connected to a first port of the first cylinder 14 can provide considerable resistance when the exerciser is pushing on the head engaging member 8 but when the user removes pressure, a spring force on the head engaging member 8 can return the head engaging member 8 to the rest position rather quickly because the flowing air can bypass the adjustable flow valve 18 and flow freely through the check valve 17. The second actuator 22 can be used to adjust the air flow and check valve operation and therefore adjust the resistance and damping, provided to the exerciser. Friction of the tracks 7 can also be utilized to control the damping and prevent the head engaging member 8 from applying a quick or snapping action on the user's head. The friction can be adjustable and it can be controlled (or adjusted) based on where the rollers 48 are on the track 7.

Additionally, second actuator 22 can adjust the resistance to forces placed on the head engaging member 8 by mechanically engaging additional biasing members 32 or by increasing the pre-tension of existing biasing members 32 on the head engaging member 8. It is preferred that adjustment of the resistance to a user's movement should not substantially change the rest position of the head engaging member 8. It is desirable to be able to change the resistance of head engaging member 8 such that larger and stronger individuals can get an exhaustive workout while using the exercising machine. A fourth actuator 44 can be utilized to adjust the inside dimension of the head engaging member 8 to accommodate different head sizes by reducing the perimeter of the contact surface 31 for users with a smaller head. Fourth actuator 44 can move coupling members 45 closer together (and therefore move contact surfaces 31 together) using a cam or a lead screw assembly.

Although the first track 60 and second track 11 are illustrated as curved tracks, a linear mechanical track which does not move in the Z direction would not part from the scope of the present invention. However, it is preferred that the arc of the tracks 7 moves the head engaging apparatus in an arc that is substantially similar to the radius of the movement the average individuals head from the shoulders to the chest, back and shoulders. It is preferred to control the movement of the head engaging member on a track such that as the head engaging member 8 moves from the rest position it moves downward in the Z direction and moves along a path which has a radius from between five and twelve inches.

Figure 4:
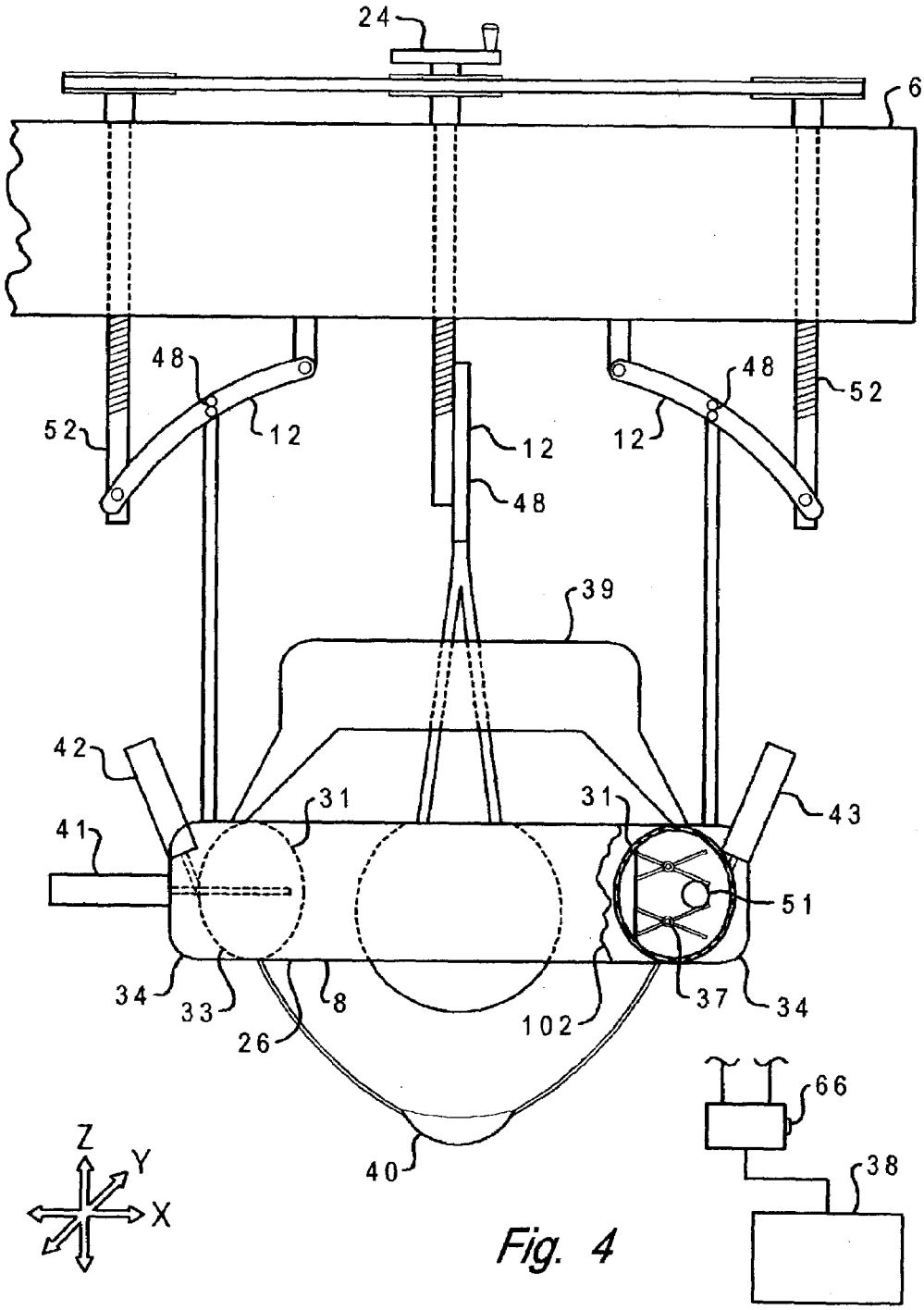
FIG. 4 is a side view of a head engaging member and a four track multi-directional track system having and an adjustable arc path for an exercising machine.

Referring to FIG. 4 adjustable angle linear tracks 12 can be utilized to change the three dimensional motion of the head engaging member 8 as it moves from the rest position. In FIGS. 3 and 4 like elements have like callouts. The embodiment in FIG. 4 allows the user to adjust the position of track 12 and thereby select the path which the head engaging member 8 will travel when pushed on. A user can select a purely planar movement for the head engaging apparatus or a quick rotation of the head engaging member as it leaves the rest position. A small individual with a short neck may require a movement of the head engaging member having a rotation of four inches. The rotation allows a user to rotate his neck and maintain a point of contact of his head with the head engaging member without slippage on the head engaging member 8 on the skin during exercise. The arc or radius of movement of the head engaging apparatus 8 about the rest position of the head engaging member 8 can be adjusted by rotating third actuator 24 and a three dimensional movement of the head engaging member can be selected.

Turning third actuator 24 turns lead screws 52 which pull or push one end of the angled tracks 12 while the other end of the angled track 12 pivots. Third actuator 24 can be coupled to lead screws 52 using a belt and pulley system or chain sprocket system. A user can adjust the path traveled by the head engaging member 8 such that it matches the radius of his or her head rotation or desired feel. Thus, if an exerciser desires that the head engaging member 8 maintains a relatively constant pressure point on the exerciser's head when he/she pushes on the head engaging member 8 the path or rotation of the head engaging member 8 can be adjusted accordingly. If the arc motion is perfectly adjusted to the radius of rotation of an individual the head engaging member 8 will not slip upward on a user's head during a neck rotation. If properly adjusted the angled tracks 12 ensure that the head engaging member 8 moves downward in the Z direction as a user pushes it away from the rest position, thus maintaining a contact point on the exerciser's head as the exerciser moves the head engaging member 8 by rotating his/her head.

It is preferred that the contact surface 31 of the head engaging member 8 is arcuate, substantially circular or elliptical. A single size head engaging member 8 provides sufficient performance, however, an adjustable inner diameter of a head engaging member 8 can provide improved functionality for certain users. In one embodiment the adjustable head engaging member 8 is made from a one piece ring 34 which retains at least one expandable air chamber 33 and at least one contact interface 31 such that expanding the air chamber 33 moves the contact surface 31 in relation to the ring 34 and engages various portions of the user's head. It is preferred to have one fixed contact surface for engaging the back of the head and the expanding air chamber(s) 33 on all other sides. As the air chambers are filled with compressed air, the gap between the contact surfaces 31 and the user's head is closed on all sides. Specifically, by moving the contact surfaces 31 towards the center of the ring 34 from the front, left, right, bottom (chinstrap 40) and top (cap 39) the contact surfaces can be uniformly move towards a user's head. The expandable air chamber 33 can be comprised of one or many small elastic or rubberized bladders or it can be comprised of air cylinders such as fifth air cylinder 41 or anything that moves when air is forced into an air chamber. Sixth air cylinder 42 and seventh air cylinder 43 can retract when air is placed in their second port and the chinstrap 40 can tighten on the user's chin. Shown in cut away window 102 is another embodiment for a head engaging member 8 adjustment, a scissors linkage 37 having an eighth cylinder 51 to activate the scissors is used. The scissors linkage 37 maintains a low profile between the ring 34 and the contact surface 31 and provides for extensive movement of the contact interface 31 towards the user's head. Tracks 12, held by frame 6 can provide a surface for rollers 48 to roll on. A machine for generating compressed air such as an air compressor 38 would be required to actuate the air chambers through a user controlled valve 66.

FIG. 5 illustrates an alternate multidirectional track system 70 which moves the head engaging member 8 in the Z plane as it moves in the X or Y plane or as the head engaging harness 8 moves from the rest position. In FIGS. 1–5 like components have like callouts. Head engaging member 8 is connected to pushrods 29 and the pushrods 29 are slidably engaged with tracks 7. Pushrod spring 30 biases the pushrods 29 such that they contact a dish 21. Pushrod rollers 68 can be placed on the pushrod 29 where pushrods 29 contact dish 21. As the head engaging member 8 moves away from the rest position the dish 21 forces the pushrods 29 downward. Pushrod rollers 68 allow pushrods 29 to easily slide along the surface of dish 21. As the head engaging member 8 is moved from the rest position the pushrods 29 follows the form of the dish 21 and move the head engaging members in an arc motion (if the head engaging member 8 moves in the X or Y plane the multidirectional track forces movement in the Z direction). A variable size head engaging member 8 can be made from a first member 26 and a second member 27 and an air cylinder or a lead screw 64 being driven by forth actuator 44.

Figure 6:
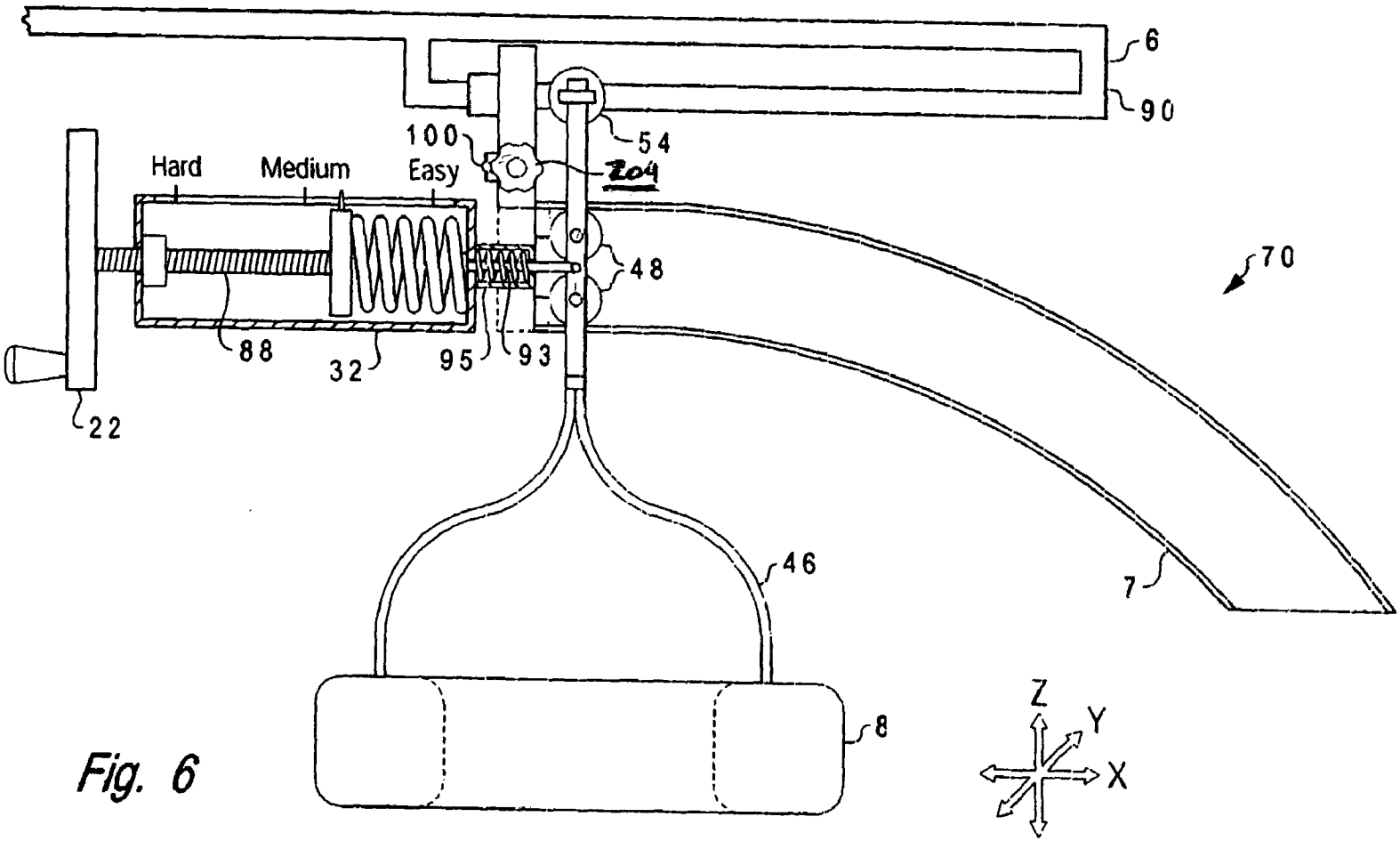
FIG. 6 is a side view of an alternate multi-directional track system which can provide multi-directional movement for an exercise machine.

Referring to FIG. 6 another embodiment of a multidirectional track 70 with a head engaging member 8 is illustrated. In FIGS. 1–6 like components have like callouts. Hinge 100 can be adjusted to increase the curvature of the path traveled by the head engaging member 8. Thumb screw 204 can be loosened then the hinge 100 can be adjusted to provide the desired curvature path of the head engaging member 8 and thumb screw 204 can be retightened. Second actuator 22 is coupled to second lead screw 88 which is coupled to biasing member 32. Rotating second actuator 22 increases or decreases the force which biasing member 32 places on the resistance to movement of the head engaging member 8. A damping member 95 or cable 93 can couple rollers 48 to biasing member 32. Head engaging member 8 is attached to coupling members 46 which are coupled to rollers 48. Rollers ride on track 7. As an exerciser places a force on head engaging member 8 the track 7 will rotate about swivel 54 and align with the direction of the force placed on head engaging member 8 by the user.

As the track 7 swings in different directions according to the direction of the users push, angular positioner system 90 keeps the head engaging apparatus 8 from rotating in relation to the X-Y plane and forces translation in the X-Y plane much like the tracks in FIG. 5. Regardless of the torsional force and the directional force placed on the head engaging apparatus 8 by the user angular positioner 90 can maintain a constant orientation of the head engaging member 8 in the X-Y plane as the head engaging member 8 moves in any direction in the X Y plane (it translates).

Figure 7:
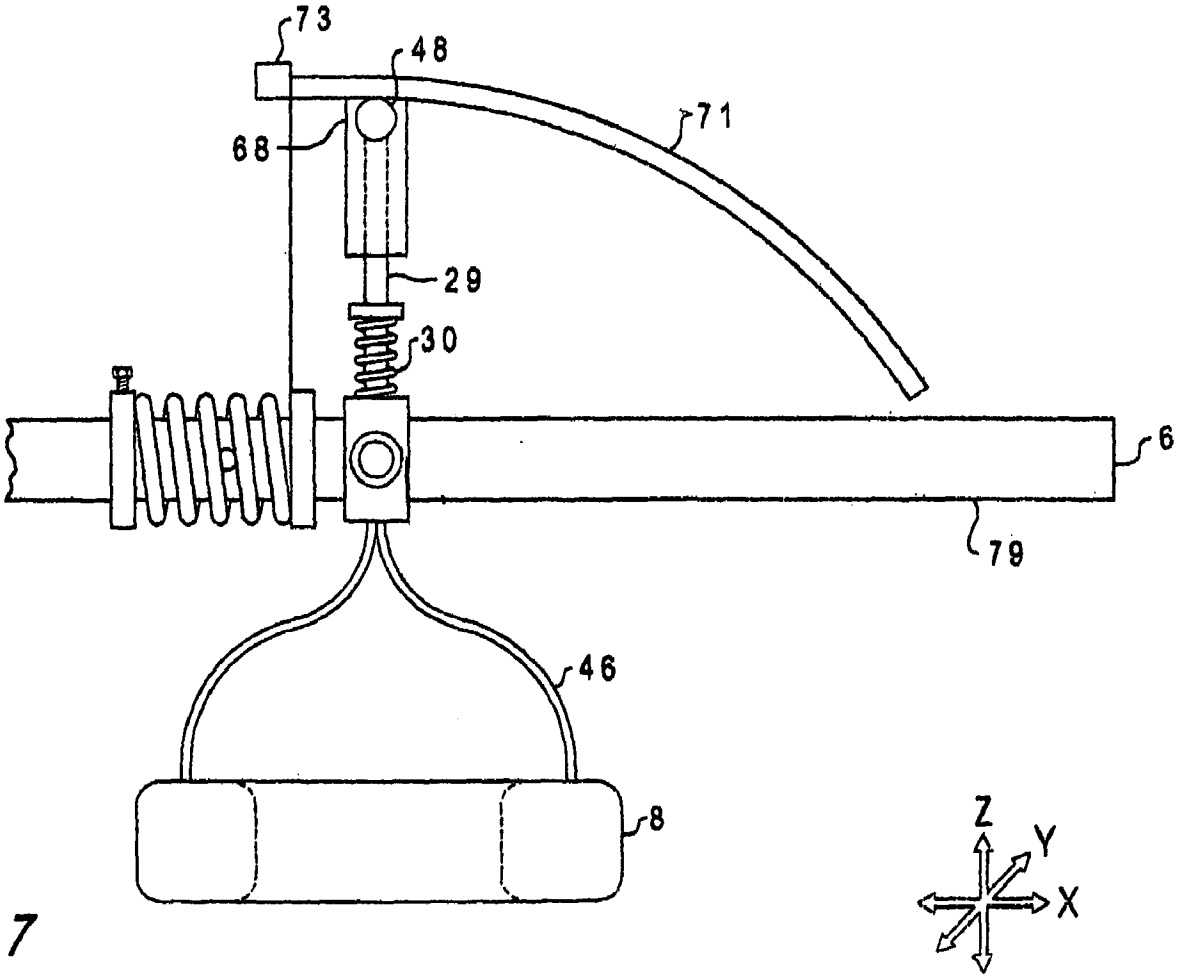
FIG. 7 is a side view of a multi-directional track system having an adjustable path for an exercise machine.

FIG. 7 is a side view of another multi-directional track system that can be implemented as the multidirectional track system 70 in FIG 1. When a user places a force on the head engaging member 8 in the X or Y plane, pushrod rollers 48 and 68 roll on a surface of arc track 71 (a half dish would also work). The arc track 71 has a swivel 73 and swings in the direction of the exerciser's push. The arc of the arc track 71, forces pushrods 29 downward compressing push rod springs 30 moving head engaging member 8 downward (in the Z direction) as it moves in the X or Y direction. The head engaging member 8 maintains its X-Y orientation as it translates through the X-Y plane and moves in the Z direction to follow the rotation of a neck. It can be seen that arm assembly 6 is parallel to components of the head engaging member 8 when the head engaging member 8 is in the rest position and after movement of the head engaging member 8, the arm assembly 6 remains substantially parallel to the head engaging member 8.

Figure 8:
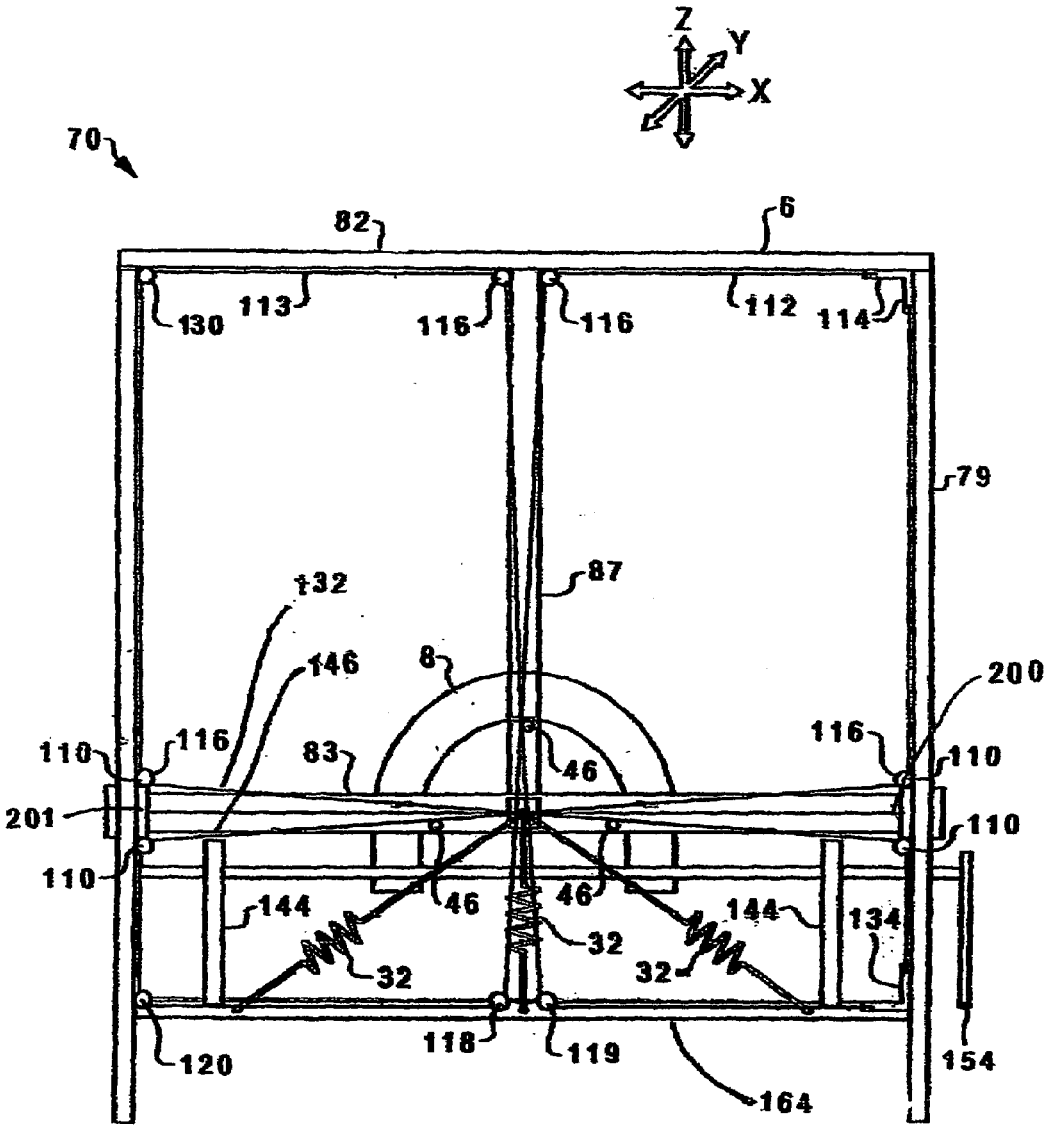
FIG. 8 is a top view of the multi-directional track shown in FIG. 7.

Referring to FIG. 8, a top view of another multi directional track system that can be implemented as the multidirectional track system 70 disclosed in FIG 1 is illustrated. In this embodiment, arm assembly 6 can be a square frame. As head engaging member 8 moves from the rest position in the Y direction, first arcuate track 83 and the head engaging member 8 moves in relation to first rail 79 and along second arcuate track 87. Conversely, as the head engaging member 8 moves in the X direction, the head engaging member 8 moves in relation to the first arcuate track 83 and the second arcuate track 87 moves along second rail 82. The tracks and rails keep the head engaging member from rotating about the tracks 83 and 87 regardless of the torsional force and the directional force placed on the head engaging apparatus 8 by the user. Head engaging member 8 maintains a constant hemispherical orientation in the X-Y-Z plane as the head engaging member 8 moves in any direction responsive to a user force during exercise. As in previous embodiments, coupling members 46 couple head engaging member 8 to rollers in the first arcuate track 83 and second arcuate track 87.

First cable 112 is anchored at one end by tensioner 114 and runs along second rail 82 to first pulley 116 where it turns a corner and runs along second arcuate track 87 to second pulley 118, turns another corner where it is anchored at a second end at corner 120. Correspondingly, a second cable 113 is placed symmetric to cable 112 (symmetric about second arcuate member in the rest position). Second cable 113 is anchored at third corner 130 proceeds along second rail 82 through pulley 116 and then along second arcuate track 87, through pulley 119 and is anchored at fourth corner 134. First cable 112 and second cable 113 provide a smooth motion when the head engaging member 8 is moved in the X direction. Third and fourth cables 132 and 146 can be implemented along first arcuate track 83 to prevent binding for movements in the Y direction.

To adjust the tension on the biasing members 32, lever 154 can be pulled and correspondingly cams 144 rotate to move biasing member anchor 164 along first rail 79 farther away from the rest position of the head engaging member 8 thereby increasing the resistive force of the biasing members 32 on correspondingly increasing the resistance to an exerciser's force on the head engaging member 8. First arcuate track 83 and second arcuate track 87 have a bearing where they ride on first rail 79 and second rail 82. Between the rails 82 and 79 and the first arcuate track 83, pivots 200 and 201 are located such that the track 83 can tilt and provide a hemispherical motion of the head engaging member 8 when a user force is applied during exercise.

The foregoing is a detailed description of preferred embodiments of the invention. Various modifications and additions can be made without departing from the spirit and scope of the invention. Accordingly, this description is only meant to be taken by way of example and not to otherwise limit the scope of the invention.

The invention claimed is:

1. An exercise machine comprising:

a frame;

an arcuate track having a first end and a second end coupled to the frame, the arcuate track pivotable about the first end and the second end; and a head engaging member coupled to the arcuate track and configured to move in relation to the arcuate track in response to a force on the head engaging member applied by a user's head during exercise.

2. The exercise machine as in claim 1 further comprising a resistance system configured to provide a resistance to movement of the head engaging member as the head engaging member moves in relation to the arcuate track.

3. The exercise machine as in claim 2 wherein the resistance system further comprises at least one adjustable biasing member, wherein the head engaging member has a rest position where the head engaging member resides before any user force is applied to the head engaging member and after a user force is applied to the head engaging member the at least one biasing member provides a selectable resistance to a user induced movement of the head engaging member from the rest position.

4. The exercise machine as in claim 1 wherein when the head engaging member moves from a rest position it moves in curved path defined by a radius that is approximately equal to a distance from a human's forehead to a base of the human's neck.

5. The exercise machine as in claim 1, wherein a path which the head engaging member moves from a rest position can be adjusted by the user.

6. The exercise machine as in claim 1, further comprising adjusting an inner diameter of the head engaging member with flip down members.

7. The exercise machine as in claim 1, further comprising at least one roller having an axis, the roller slidably engaging the head engaging member to the arcuate track.

8. A device to exercise human muscles comprising:

a frame;

an arcuate track coupled to the frame via at least a first pivot; and a head engaging member slidably mounted to the arcuate track via cylindrical rollers and a bottom surface with a rigid opening for insertion of the head such that when a force is applied to the head engaging member, the head engaging member can move in a multidirectional path defined by a center and a radius that will provide a hemispherical movement of the head engaging member.

9. The device as in claim 8 further comprising a non-absorbent fabric coupled to the rigid opening.

10. The device as in claim 9 further comprising padding coupling to the rigid opening.

11. The device as in claim 8 further comprising a marking on the frame to indicate a setting corresponding to a user's height.

12. The device as in claim 8 further comprising a member configured to adjust a path traveled by the head engaging member as the head engaging member moves from a rest position.

13. An exercising machine comprising:

a frame;

an arcuate track pivotable on the frame;

a head engaging member coupled to at least one cylindrically shaped roller, the at least one cylindrically shaped roller configured to roll on a surface of the arcuate track, said head engaging member configured to move along the arcuate track in response to force applied by a user's head during exercise; and a resistance assembly to provide resistance to movement of the head engaging member while the head engaging member moves along the arcuate track.

14. The exercise machine as in claim 13 wherein the head engaging member is coupled to a second cylindrical shaped roller and the at least one cylindrical shaped roller and the second cylindrically shaped roller are configured to roll on opposing sides of the arcuate track.

15. The exercise machine as in claim 13 further including an expandable air chamber coupled to the head engaging member.

16. The exercise machine as in claim 13 further comprising at least a second air chamber for moving a least one contact surface to engage a user's head.

17. The exercise machine as in claim 16 wherein the at least one contact surface is one of a chin strap a forehead pad, a cap, a side pad, and a rear pad.

18. The exercising machine as in claim 13 further comprising a scissors mechanism coupled to a rigid arcuate member and to a contact surface.

19. A neck exercising machine comprising:

an arcuate track having a first end and a second end;

a first pivot point proximate to the first end of the arcuate track;

a second pivot point proximate to the second end of the arcuate track;

a frame configured to locate the first and second pivot points along a common axis allowing the arcuate track to pivot about the common axis;

a head engaging member configured to move in relation to the arcuate track in response to a user force, such that a controlled movement of the head engaging member in an X, Y and Z motion that has components equidistant from a single central location; and a resistance assembly to provide a resistance to movement of the head engaging member while the head engaging member moves over the equidistant components.

20. The neck exercising machine as in claim 19 wherein the arcuate track defines movement of the head engaging apparatus in the X, Y and Z direction as the head engaging member moves in one of an X or Y direction.

21. The neck exercising machine as in claim 19 further comprising means for adjusting the path traveled by the head engaging member.

22. The neck exercising machine as in claim 19 wherein the resistance assembly includes a biasing member configured to adjust the resistance to movement of the head engaging member.

23. The neck exercising machine as in claim 19 further comprising an expandable member configured to adjust an inside dimension of the head engaging member.

24. A neck muscle conditioning unit comprising;

rollers each supported about an axis;

a head engaging member coupled to the rollers;

a pivotable arcuate track configured to provide a rolling surface for the rollers;

wherein the head engaging member moves about locations defined by a partial spherical surface having radius approximated to a distance from a user's forehead to the base of the user's neck responsive to a force placed on the head engaging member by the user's head during exercise.

25. A machine for exercising muscles of the spinal column comprising:

a frame;

a vertical member coupled to the frame to support a pivotable arcuate track having an outside surface; and a head engaging member coupled to the pivotable arcuate track via rollers, the rollers riding on the outside surface of the track, the track pivotable responsive to a force placed on the head engaging member by a user's head during exercise.

26. The machine as in claim 25 further comprising: a second frame and a third frame member having a segment suitable for a user to grasp while exercising the muscles of the spinal column.

* * * * *